US007678066B2

(12) United States Patent
Habatjou

(10) Patent No.: US 7,678,066 B2
(45) Date of Patent: Mar. 16, 2010

(54) COOLING MASSAGE DEVICE AND PRODUCT DISPENSER INCLUDING SUCH A DEVICE

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 484 days.

(21) Appl. No.: 11/608,191

(22) Filed: Dec. 7, 2006

(65) Prior Publication Data

US 2007/0125113 A1 Jun. 7, 2007

Related U.S. Application Data

(60) Provisional application No. 60/751,993, filed on Dec. 21, 2005.

(30) Foreign Application Priority Data

Dec. 7, 2005 (FR) ..... 05 12430

(51) Int. Cl.
*A61H 7/00* (2006.01)

(52) U.S. Cl. ..... 601/15; 62/293; 62/457.1; 401/209; 601/17; 601/19; 601/128; 601/129; 601/131; 607/104; 607/108

(58) Field of Classification Search ..... 62/293, 62/457.1, 457.9; 401/209, 216; 601/15, 601/17, 19, 128–129, 131; 607/96, 104, 607/108–111, 114

See application file for complete search history.

(56) References Cited

U.S. PATENT DOCUMENTS

| | | | | | |
|---|---|---|---|---|---|
| 1,534,974 | A * | 4/1925 | Linden | 601/15 |
| 1,833,105 | A * | 11/1931 | Aronson | 601/15 |
| 1,877,616 | A * | 9/1932 | Strelitz | 601/15 |
| 2,472,385 | A * | 6/1949 | Rollman | 601/15 |
| 4,584,847 | A | 4/1986 | Martello et al. | |
| 4,681,095 | A * | 7/1987 | Bontemps | 601/15 |
| 4,745,909 | A * | 5/1988 | Pelton et al. | 601/15 |
| 4,884,560 | A * | 12/1989 | Kuracina | 601/19 |
| 5,090,402 | A * | 2/1992 | Bazin et al. | 601/17 |
| 6,413,255 | B1 | 7/2002 | Stern | |
| 6,866,776 | B2 * | 3/2005 | Leason et al. | 210/201 |
| 2004/0194472 | A1 | 10/2004 | Wohland et al. | |
| 2005/0015030 | A1 * | 1/2005 | Bousfield et al. | 601/113 |

FOREIGN PATENT DOCUMENTS

| | | |
|---|---|---|
| DE | 102 11 483 | 9/2003 |
| WO | WO 2004/100704 | 11/2004 |

* cited by examiner

*Primary Examiner*—William E Tapolcai
(74) *Attorney, Agent, or Firm*—Oblon, Spivak, McClelland, Maier & Neustadt, L.L.P.

(57) ABSTRACT

A massage and/or dispensing device includes a body, and an applicator element intended to be placed in contact with a surface to be massaged and/or a surface to which a product is to be applied. The applicator element is movably retained in the body or mounted for movement relative to the body. The arrangement further includes a cooling arrangement which includes means of expanding a refrigerant liquefied gas directly in contact with the applicator element.

28 Claims, 2 Drawing Sheets

COOLING MASSAGE DEVICE AND PRODUCT DISPENSER INCLUDING SUCH A DEVICE

CROSS-REFERENCE TO RELATED APPLICATIONS

This document claims priority to French Application Number 05 12430, filed Dec. 7, 2005 and U.S. Provisional Application No. 60/751,993, filed Dec. 21, 2005, the entire content of which are hereby incorporated by reference.

FIELD OF THE INVENTION

The invention relates to massage devices, in particular for massaging the skin. An example of an embodiment includes a dispensing device for cosmetic products having at least one massage device, however, the invention can also be utilized for massagers that do not dispense a product.

BACKGROUND OF THE INVENTION

Discussion of Background

It is desirable in certain cases to cool a cosmetic product for its application so as to enhance the effect thereof or to impart a sensation of freshness and comfort during application.

For this reason, when a user wishes to apply a pre-cooled cosmetic product onto his or her skin, the product is sometimes kept in the refrigerator. However, when the product needs to be applied outside, the pre-cooled product warms up rapidly, in particular when the ambient temperature is elevated, so that the product no longer imparts the refreshing effect sought.

Product dispensers including a cooling device have been developed to overcome this drawback.

International patent application WO 2004/100704 describes a cosmetic product dispenser equipped with its own cooling device and which is used to apply a cooled product. This dispenser includes a first container holding the product to be applied and a second container holding a refrigerant gas. In the device described in this document, the product to be dispensed circulates along a cooling coil in a conduit disposed in the coil. The coil and the conduit are both disposed in a push button which serves to actuate two dispensing valves, one mounted on the product storage container and the other on the refrigerant gas storage container.

This type of device makes it possible to cool a measured quantity of cosmetic product during its application but in an arrangement that is cumbersome and, consequently, restricted in its ease of use.

Moreover, the dispenser described in WO 2004/100704 has poor compatibility with different types of applicator elements.

U.S. Pat. No. 4,584,847 describes a device including a lipstick and a device for cooling this stick. The stick is movably mounted relative to a holder so that it can be brought from a stowed position in which the stick is disposed inside the holder to a usage position in which the stick projects beyond the holder. The device includes a closure cap designed to be mounted on the holder when the stick is in the stowed position. The closure cap includes the cooling device.

This device poses a problem in that the cooling action can only be obtained when the stick is in the stowed position. Cooling cannot be obtained when the stick is in the usage position. Furthermore, the device described in this document is only suitable for cooling a lipstick fitted with a cap.

Unpublished French patent application No. 0 552 654, filed in the applicant's name, describes a cooling device for a product packaging device. The cooling device includes a pressurized container holding a refrigerant product and a holder to receive the packaging device to be cooled. The holder is mounted on a valve with which the pressurized container is equipped and is arranged so that the refrigerant product is brought against an outer surface of the packaging device.

However, this cooling device is essentially applicable only for a product packaging device arranged in the form of a cup forming a reservoir filled with the product to be applied. It is unsuitable for cooling a product intended to be applied by an applicator such as a ball or a rotating drum.

SUMMARY OF THE INVENTION

One of the objects of the invention is to provide a massaging device capable of applying a cooling effect in a sustained manner throughout the massaging action. To this end, an example of the invention includes a massage device including a body and an applicator element intended to be placed in contact with a surface to be massaged. The applicator element is movably retained in the body, and the device includes a cooling arrangement, which includes a means of expanding a refrigerant liquefied gas directly in contact with the applicator element.

Advantageously, by way of example, a device according to the invention can also be designed to allow the expansion of the refrigerant gas directly against the surface to be massaged.

In an advantageous example, the cooling means or arrangement can include a can for storage of the gas in liquid form upon which the body is mounted. The can may be equipped with an actuating valve. The valve can be equipped with a rod actuated by downward axial movement.

By way of example, the cooling arrangement can preferably include a conduit for circulation or passage of the gas emerging at the applicator element. The applicator element is, for example, disposed against a first free end of the conduit. The diffusion of product at the free end is, for example, centered on the center of mass of the applicator element. The conduit is in fluid communication with the valve at a second free end of the conduit opposite the first end. The second end of the conduit is then, for example, provided with a head which is mounted on the valve.

Further by way of example, the device can include a plurality of mobile or movable applicator elements retained in the body. Advantageously, in this case, the conduit can include as many first free ends as there are applicator elements, each emerging at one of the applicator elements and being in communication with the valve.

The first end can be, for example, of a generally concave shape counterpart to that of the applicator element. According to an embodiment, the applicator element can be a ball applicator. In this case, the applicator ball is preferably made of a metallic material or at least partially of a metallic material.

Advantageously, accordingly to an example, the device can include an outer enclosure in which the cooling means are housed. Grasping of the device is thus facilitated and avoids direct contact with the can which could be cold.

According to another example, the invention provides a cosmetic product dispenser, of the type including cooling means or a cooling arrangement serving to cool the product during the application thereof.

Another object of the invention is to provide a product dispenser of the type discussed above, having reduced dimensions, in which the cooling means are such that they facilitate the application of a cooled cosmetic product using different types of applicator elements.

The invention is advantageous for dispensing and applying a cosmetic product. An example of an embodiment includes a reservoir intended to contain the product, and a massage device. The reservoir is defined around a part of the cooling device, and an applicator element is in fluid communication with the reservoir.

According to a preferred feature of the dispenser, the cooling means or cooling device is arranged to directly cool the applicator element. Thus, by virtue of this arrangement, it is no longer necessary to provide a cumbersome cooling coil, and the cooling effect can be obtained by lowering the temperature of the product applicator element.

The reservoir can, for example, be mounted around the gas circulation conduit, and can be delineated by the body and a fitted bottom and provided with an opening for the passage of the conduit. A dispensing aperture of the reservoir can be defined around the first free end of the conduit. Advantageously, the body can include a first part with a radial dimension greater than that of a second part, with the parts being separated by a peripheral median shoulder.

The invention also provides a method of applying a product, in particular a cosmetic product, contained in a dispenser equipped with a reservoir holding the product. According to a preferred example, a product applicator communicates with the reservoir and cooling device to cool the product during the application thereof. In addition, during application, the applicator element is directly cooled.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
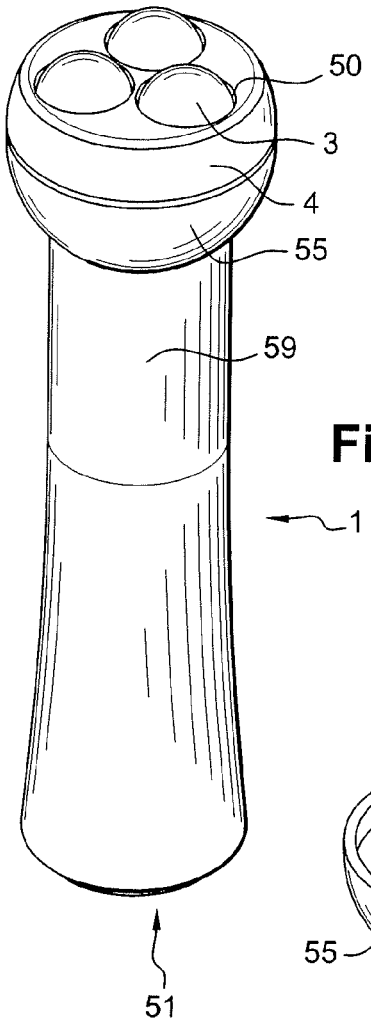
FIG. 1 is a perspective view of a cooling massage device according to an example of the invention.

Referring now to the drawings, like reference numerals are utilized to designate identical or corresponding parts throughout the several views.

Figure 3:
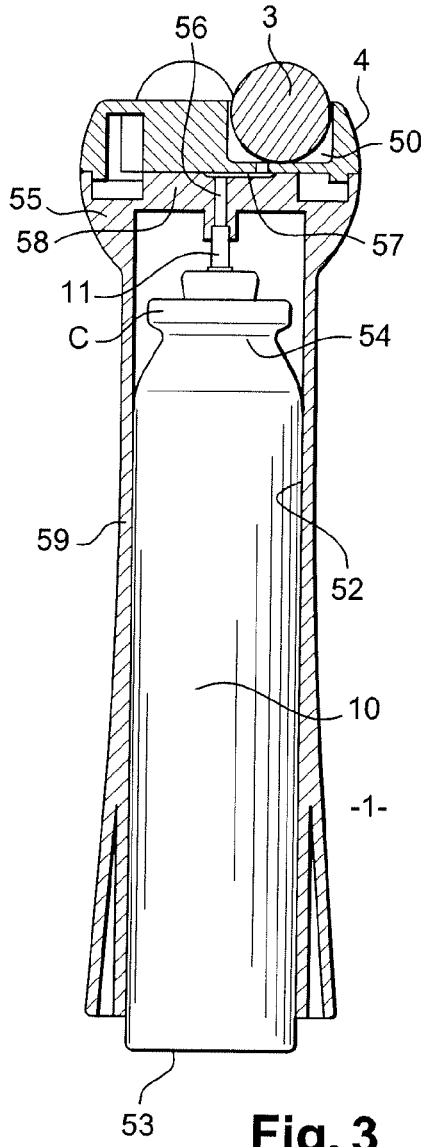
FIG. 3 is a lengthwise sectional view of the device in FIG. 1.
Figure 2:
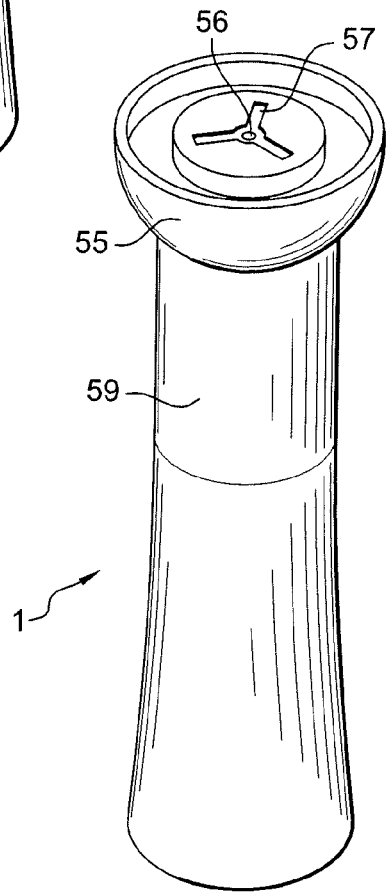
FIG. 2 is a partial perspective view of the device in FIG. 1.

FIG. 1 shows a massage device 1 according to an example of the invention. This device 1 includes an applicator element 3 and a body 4. The applicator element is retained freely in rotation in the body 4, so that it can be driven in rotation when it is placed in contact with a surface to be massaged. As used herein, the "applicator element" may, but is not required to, apply a product onto the skin. For example, the arrangement of FIGS. 1-3 does not include a product dispenser, and can be used to simply provide a massaging action. Alternately, a product could be applied separately, and after application, a device as shown in FIGS. 1-3 could be used to spread and/or massage the product onto the surface. Further, as discussed later in conjunction with the example of FIG. 4, a device according to the invention could also have a product dispenser associated therewith. Such devices 1 can be useful, for example, for massaging the skin, and particularly the scalp.

In the example of an embodiment in FIGS. 1 to 3, the device 1 includes three applicator elements such as 3. These applicator elements take the form of metal balls retained freely in rotation in seatings respectively 50 in the body 4. It is to be understood that various alternative applicators could also be used.

In the illustrated example, the device 1 includes cooling means 51 essentially including a can of liquefied gas 10 wherein a refrigerant gas (i.e., which is a gas in room or non-pressurized conditions) is stored under pressure in the can. Use can be made, for example, of a gas which has the property of being in the liquid state when it is under pressure in the can and of vaporizing and cooling when it expands. By way of example, a hydrocarbon, for example butane 3, 2, dimethylether, or a freon, for example HFC 134a can be used to cool the ball.

The can 10 in the illustrated example, essentially includes a cylindrical outer wall 52 having a closed proximal end 53 and a distal end 54 closed off by a cup C crimped onto a rolled rim of the body. The cylindrical wall has a lengthwise axis X-X' which substantially corresponds to an axis of symmetry of the device 1.

The can 10 is also equipped with a dispensing valve 11 crimped onto the cup C. The valve 11 advantageously includes a valve actuated by downward movement. It is provided with a hollow actuating rod intended to dispense the refrigerant gas when it is pressed downward.

It will be noted that, preferably, the valve 11 includes a proportioning valve to allow a measured quantity of refrigerant gas to be dispensed each time the valve is pressed and thereby avoid discharging the container during a single actuation.

In the example illustrated, a circulation conduit 12 is formed between a part 55 mounted on the actuating rod and the body 4. This circulation conduit 12 emerges against the applicator element and against each of the applicator elements as the case may be. This part 55 includes a channel 56 forming part of the circulation conduit 12. In the example embodiment illustrated in FIGS. 2 and 3, this channel 56 emerges respectively into three evenly spaced grooves 57 formed in the body 4 and emerging respectively into each of the recesses 50 so as to cool the outer surface of the applicator elements which are respectively housed therein. The face of the body 4 presenting the grooves 57 is applied against a flat face of the part 55 so that the circulation conduit divides into three branches.

The part 55 includes a mounting head 14 configured to fit tightly around the actuating rod of the valve 11. This mounting head 14 is defined opposite the channel 56. The mounting head is formed in a plate 58 of the part 55. An outer enclosure 59 is disposed on this plate 58 so as to define a recess inside which the can 10 is able to be concealed.

The can 10 is mounted freely in translation inside the outer enclosure 59 such that an actuation of the valve 11 is obtained by exerting pressure on the closed proximal end 53 of the can 10. Actuation is obtained by a relative movement between the can and the outer enclosure 59. In this example, the closed proximal end 53 extends axially beyond the outer enclosure 59 by a length corresponding to the travel distance over which the actuating rod can be moved relative to the body of the valve 11.

By way of example, the use of such a device can preferably carried out in two steps. In a first step, the valve is actuated, refrigerant gas is released and propagates through the circulation conduit 12, and the flow of refrigerant gas is delivered to the applicator elements, which are then progressively cooled. Then, in a second step, the user grasps the outer enclosure and exerts a massaging action on the skin by means of the cooled applicator elements, which can be caused to rotate by virtue of this contact. When the massage is being affected, the refrigerant gas is not dispensed. As an alternative, the refrigerant can be fed from the can while the applicator elements are in contact with a surface being massaged. In this case, depending upon clearances provided and the amount of flow of refrigerant, refrigerant gas can pass around the applicator elements and further expand as it exits the device to additionally expand against and directly cool the surface being massaged if desired.

As a variant of the embodiment in FIGS. 1 to 3, the outer enclosure can be shorter so that the outer enclosure 59 only surrounds an axial portion of the can 10. In such a configuration, depending on which part of the outer enclosure 49 or of the emergent can 10 is grasped, the user can choose whether or not to dispense refrigerant product at the same time as affecting the massage.

Figure 4:
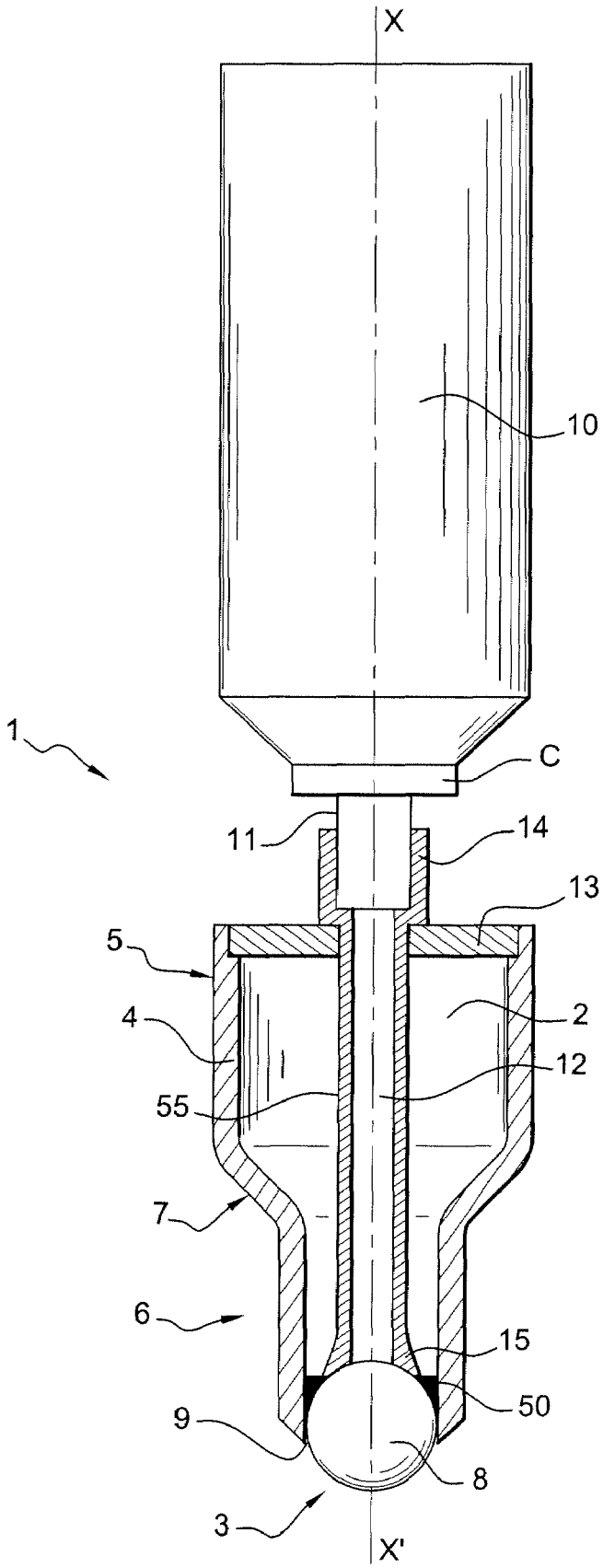
FIG. 4 is a lengthwise sectional view of a product dispenser according to an example of the invention.

FIG. 4 illustrates an example of a cosmetic product dispenser 1 according to the invention, in the use position. The dispenser 1 has a substantially vertical general axis of symmetry X-X'. It is intended to apply a cooled cosmetic product, such as a cream. To this end, the dispenser 1 includes a device 1 according to an example of the invention.

The expression "cosmetic product" is understood to mean a product as defined in EC Council Directive 93/35/CEE dated 14 Jun. 1993. However, the invention can also apply to other products, depending on the application envisaged.

The dispenser 1 includes a reservoir 2 pre-filled with product to be dispensed. The reservoir 2 is formed between the body 4 and the part 55. In this embodiment, the part 55 is presented in the form of a tube. The applicator element 3 is mounted on the reservoir 2, between a free end 15 of the part 55, opposite the attachment head 14, and an opening delineated by the recess 50 formed in the body 4.

The applicator element 3 serves to apply the product taken up at its surface when it is caused to rotate relative to the reservoir 2. In this instance, the applicator element 3 takes the form of a ball 8. The dispenser 1 is provided with cooling means intended to cool the ball 8 during application of the product.

In the example embodiment shown, the applicator element 3 is a ball applicator of the "roll on" type. However, the invention also applies to product dispensers provided with any other type of applicator element, such as drum or a roller applicator, which can be made of foam or any other material permeable to the product to be applied. In addition, although one applicator element is shown in FIG. 4, plural applicator elements could be provided as in the embodiment of FIGS. 1-3.

As can be seen in FIG. 4, the body 4 internally delineates the product storage volume. The illustrated example includes a generally cylindrical proximal zone 5 of wide cross-section essentially providing storage for the product and a distal zone of narrow cross-section 6 also generally cylindrical in shape and having an inside diameter corresponding to that of the ball 8. The seating 50 for the ball 8 is formed in the narrow distal zone 6.

The proximal and distal zones are separated by an annular median shoulder 7 in the shape of a truncated cone of evenly diminishing cross-section from the wide zone 5 to the narrow zone 6. As discussed below, this shoulder can be used to form a seating designed to receive a cap. It also has the function of conveying the product towards the narrow zone 6.

The inner peripheral surface of the narrow distal zone 6 is provided with a concave annular portion 9 having a shape generally counterpart to that of the ball 8 of the applicator 3. The concave annular portion 9 is formed so as to hold the ball 8 in the body 4, while at the same time allowing rotation of the ball and limited axial movement of the ball. This concave annular portion defines a bottom of the recess 50. It is, for example, made in the form of an end-piece fitted into the distal end of the body 4 or retained therein by any other suitable means. Advantageously, this annular portion 9 facilitates coating of the outer surface of the ball 8 with a thin layer of product. This annular portion 9 extends around the free end 15 of the part 55 in the form of a tube.

In this example embodiment, the inner conduit 12, delineated by the tube 55 and at the end of which the ball 8 is seated is generally rectilinear and coaxial with the body 4. It extends from a bottom 13 fitted on the body 4. The bottom 13 cooperates with the outer surface of the part 55 to ensure leaktight closure of the container 2.

The part 55 passes through the bottom 13 and extends externally by a head 14 mounted on the valve 11.

The distal end of the part 55 has a generally concave shape counterpart to that of the ball 8. This end thus forms a seating on which the ball 8 rests.

As previously indicated, the can 10 is filled with a liquefied gas under pressure capable of cooling by expansion. The ball is preferably made of a metallic material capable of cooling readily under the effect of the gas emerging from the conduit 12. It is capable of moving in rotation in the annular portion of the distal end of the body 4.

During use, when the ball 8 is moved over an application surface, that is to say over the skin of a user, the ball is caused to rotate. Rotation of the ball causes, on one side, product to be taken up from the internal volume of the reservoir 2 and, on the other side, application of the product thus taken up onto the skin.

At the same time as contact is made with the application surface, when pressure is applied on the ball, the ball being integral in translation with the body 4 and the part 55, actuation of the valve 11 can be obtained by means of a relative movement of the can 10 with respect to the ball 8. Alternately, if desired, the coolant could be fed to the applicator element in a first step to initially cool the applicator element, and thereafter the cooled applicator element can be used to apply the product to the skin (with or without further supply of additional refrigerant during contact with the skin).

When the force exerted on the valve is sufficient to cause the actuation thereof, liquefied gas is dispensed and expands in the conduit 12. As a result of this expansion, the liquefied gas vaporizes and cools. The cooled gas is then conveyed to the ball 8. This ball 8 and the product taken up during rotation of the latter on the skin are then cooled.

The refrigerant can expand to a gaseous state and thus cool the element 8 as it contacts the portion of the element 8 in the region near the free end or skirt 15. Further, as discussed earlier in conjunction with FIGS. 1-3, depending upon clearances selected and the refrigerant flow, the gas can further expand as it exits the device if desired such that it expands and contacts the surface to be massaged to additionally provide cooling directly to the surface. As should be recognized, as the refrigerant passes out of the device it can also contact additional areas of the ball 8.

As indicated previously, the application of cooled product imparts a refreshing effect upon application. Furthermore, when the product applied is a treatment product, for example an anti-wrinkle cream, the immediate efficacy of the product applied cold is improved, with the molecules constituting the product contracting and penetrating more effectively into the skin.

It will be noted that, in the example of FIG. 4, as the cooled gas circulates in the conduit 12, the product filling the reservoir 2 is thereby simultaneously cooled, in particular in the confined space delineated by the narrow portion 6, by heat exchange through the wall of the tube formed by the part 55.

As indicated previously, the invention applies to all types of applicator elements. It will be noted, however, that the use of a cooled ball is presently preferred to achieve a more precise application.

By way of example, the body 4 and the part 55 can be made of a thermoplastic material. Any type of thermoplastic material can be used for this purpose. Thus, acrylic-based materials, cellulose-based materials, polycarbonates, polyamides, styrenes, polyolefins, vinyls, PEPT and mixtures of these materials in variable proportions, expanded or otherwise, can be suitable.

It will also be noted that the invention makes it possible to obtain a cosmetic product dispenser having a relatively compact volume. Thus, the assembly constituted by the reservoir 2 and the can 10 can be disposed in an enclosure, for example made of synthetic material, in the form of an applicator pen provided with a removable cap seated on the annular shoulder 7 of the body 4. A particularly compact device capable of being readily transported is thus obtained.

In this case, the reservoir 2 will have a generally cylindrical shape inscribed within the principal cross-section of the can 10. The can 10 can also be made in the form of a rechargeable element capable of being removed from the enclosure for recharging.

Throughout the description, expressions such as "including one," "having one," "comprising one," "has" or "having," etc., should be regarded as synonymous with "including at least one," unless otherwise specified. The same is also true for higher numerical designations such as "includes two."

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A massage device comprising:

a body;

an applicator element which can be placed in contact with a surface to be massaged, wherein the applicator element is rotatably mounted in said body such that said applicator element rotates relative to said body during massaging, said applicator element including an outer surface which directly contacts said surface to be massaged during massaging; and cooling means comprising means of expanding a liquefied refrigerant gas such that the refrigerant directly contacts said outer surface of the applicator element.

2. A device according to claim 1, wherein the device is configured such that during massaging at least a portion of the refrigerant gas passes around the applicator element and the refrigerant directly contacts and cools the surface being massaged.

3. A device according to claim 1, wherein the cooling means includes a can for storing the refrigerant in liquid form, wherein the body is mounted on the can, and wherein the can is equipped with an actuating valve.

4. A device according to claim 3, wherein the valve is fitted with a rod which is actuated by downward axial movement.

5. A device according to claim 3, wherein the cooling means includes a conduit for conveying said refrigerant emerging at the applicator element, wherein the applicator element is disposed against a first free end of the conduit, and wherein a second end of the conduit is in fluid communication with the valve.

6. A device according to claim 5, wherein the first free end has a generally concave shape counterpart to a shape of an adjacent portion of the applicator element.

7. A device according to claim 1, wherein the applicator element is a ball which is at least partially made of a metallic material.

8. A device according to claim 1, wherein an outer enclosure houses at least a portion of the cooling means.

9. A device according to claim 8, wherein the outer enclosure is connected to said body.

10. A device according to claim 8, wherein the cooling means includes a can containing a refrigerant, and wherein the outer enclosure extends over a first portion of the can, while a second portion of the can is not enclosed by said outer enclosure, and wherein movement of said can relative to said outer enclosure causes actuation of a valve associated with said can.

11. A device according to claim 1, further including:

a reservoir which can contain a product;

wherein the reservoir is defined around a part of the cooling means; and wherein the applicator element is in fluid communication with said reservoir.

12. A device according to claim 1, wherein the cooling means includes a supply of refrigerant and a conduit extending between said supply and said applicator element.

13. A device according to claim 12, wherein a product reservoir extends around at least a portion of said conduit, and wherein the applicator element applies a product contained in said product reservoir.

14. A massage device comprising:

a body;

an applicator element which can be placed in contact with a surface to be massaged, wherein the applicator element is movably retained in said body; and cooling means comprising means of expanding a liquefied refrigerant gas, and wherein the refrigerant directly contacts the applicator element;

wherein the cooling means includes a conduit for conveying said refrigerant emerging at the applicator element, wherein the applicator element is disposed against a first free end of the conduit, and wherein a second end of the conduit is in fluid communication with a valve; and wherein a plurality of movable applicator elements are retained in the body, and wherein the conduit includes a plurality of first free ends each emerging at one of the applicator elements.

15. A device according to claim 14, wherein each first free end has a generally concave shape counterpart to a shape of an adjacent portion of each applicator element.

16. A massage device comprising:

a body;

an applicator element which can be placed in contact with a surface to be massaged, wherein the applicator element is movably retained in said body;

cooling means comprising means of expanding a liquefied refrigerant gas, and wherein the refrigerant directly contacts the applicator element;

a reservoir which can contain a product;

wherein the reservoir is defined around a part of the cooling means;

wherein the applicator element is in fluid communication with said reservoir; and wherein the cooling means includes a conduit which supplies the refrigerant to the applicator element, and wherein at least part of the reservoir is positioned around at least a portion of the conduit, wherein the reservoir is delineated by the body and a bottom, wherein the bottom includes an opening through which the conduit extends, and wherein a dispensing aperture of the reservoir is defined around a first free end of the conduit which is adjacent the applicator element.

17. A device according to claim 16, wherein the body includes a first portion which is wider than a second portion, and wherein the reservoir extends in both of said first and second portions.

18. A device according to claim 17, wherein said reservoir contains a cosmetic product, and wherein said first portion is closer to a supply of said refrigerant than said second portion, and wherein said second portion is closer to said applicator element than said first portion.

19. A method of applying a product comprising:

providing a body having an applicator element rotatably mounted in said body such that said applicator element rotates relative to said body during application of the product, said applicator element including an outer surface which directly contacts a surface to which the product is applied during application of the product, said body further including a product reservoir containing a product in communication with the applicator element;

providing a supply of refrigerant in communication with a region adjacent the applicator element so that the refrigerant flows to the applicator element to directly contact and cool the outer surface of the applicator element; and applying the product to the surface to which the product is applied using the outer surface of the applicator element with the outer surface of the applicator element cooled by refrigerant from said refrigerant supply directly contacting the outer surface of the applicator element.

20. A method according to claim 19, further including providing a conduit that extends from said refrigerant supply to said applicator element, and wherein said conduit extends through at least a portion of said product reservoir.

21. A method according to claim 20, wherein said applicator element includes at least one ball, and wherein the refrigerant is fed to directly contact the outer surface of the applicator element during application of the product to the surface to which the product is being applied.

22. A method according to claim 19, further including, during application of the product, allowing at least a portion of the refrigerant to pass around the applicator element and directly contact the surface to which the product is applied.

23. A device for applying a product comprising:

a body;

an applicator element mounted to said body;

a refrigerant supply;

at least one conduit extending from said refrigerant supply to said applicator element for cooling said applicator element; and a product reservoir in communication with said applicator element;

wherein said applicator element applies said product while the applicator element is in a cooled condition by said refrigerant;

wherein said conduit extends through a portion of said product reservoir; and wherein the product reservoir is at least partially delimited within first and second portions of said body, wherein said first portion is wider than said second portion, and wherein said first portion is closer to said refrigerant supply and said second portion is closer to said applicator element.

24. A device according to claim 23, wherein the applicator element is a massage element.

25. A device according to claim 24, wherein the applicator element is a ball.

26. A device according to claim 24, wherein the product is a cosmetic product.

27. A device according to claim 23, wherein said refrigerant supply includes a can which is movable relative to said body, and wherein movement of said can relative to said body causes refrigerant to flow from said can and expand.

28. A device according to claim 23, wherein said refrigerant flows to said applicator element during application of the product to a surface.

* * * * *